US010525704B2

(12) United States Patent
Yamada et al.

(10) Patent No.: US 10,525,704 B2
(45) Date of Patent: Jan. 7, 2020

(54) LIQUID EJECTING APPARATUS

(71) Applicant: SEIKO EPSON CORPORATION, Tokyo (JP)

(72) Inventors: Tomonori Yamada, Nagano (JP); Junya Yada, Nagano (JP); Kanako Ide, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/203,726

(22) Filed: Nov. 29, 2018

(65) Prior Publication Data

US 2019/0168506 A1 Jun. 6, 2019

(30) Foreign Application Priority Data

Dec. 1, 2017 (JP) ..... 2017-231478

(51) Int. Cl.
*B41J 2/045* (2006.01)

(52) U.S. Cl.
CPC ..... *B41J 2/04563* (2013.01); *B41J 2/04515* (2013.01); *B41J 2/04573* (2013.01); *B41J 2/04581* (2013.01)

(58) Field of Classification Search
CPC ..... B41J 2/04563; B41J 2/04573; B41J 2/04515; B41J 2/04581; B41J 2/04593
See application file for complete search history.

(56) References Cited

U.S. PATENT DOCUMENTS

2013/0335471 A1* 12/2013 Murase ..... B41J 2/04563 347/14

FOREIGN PATENT DOCUMENTS

JP 2014-014934 A 1/2014

* cited by examiner

*Primary Examiner* — Bradley W Thies
(74) *Attorney, Agent, or Firm* — Global IP Counselors, LLP

(57) ABSTRACT

A liquid ejecting apparatus includes a scanner unit, a scanner drive section that drives the scanner unit, a head unit that is provided with an ejection section, a drive signal generation section that generates a drive signal driving the ejection section, a casing in which the head unit is disposed, a temperature information output section that outputs temperature information indicating a value corresponding to a temperature in the casing, and a stop control section that decides a time length of the stop period in which generation of the drive signal is stopped based on the temperature information, in which the time length is longer when the scanner unit is driven than when the scanner unit is not driven.

9 Claims, 10 Drawing Sheets

| Sd[m] | Sd[m] DESIGNATION CONTENTS | SL[m] | |
|---|---|---|---|
| | | Tu1 | Tu2 |
| (1, 1) | LARGE DOT | H | H |
| (1, 0) | MEDIUM DOT | H | L |
| (0, 1) | SMALL DOT | L | H |
| (0, 0) | NO RECORDING | L | L |

FIG. 9

| PRODUCT NAME | PIXUS TS5130 | PIXUS MP10 | COLORIO EP-810A | COLORIO CC-570L |
|---|---|---|---|---|
| MAKER | CANON INC. | CANON INC. | SEIKO EPSON CORPORATION | SEIKO EPSON CORPORATION |
| RELEASE DATE | 09/22/2017 | 10/04/2002 | 09/14/2017 | 09/30/2002 |
| RESOLUTION (dpi) | 4800×1200 | 2400×1200 | 5760×1440 | 1440×720 |
| POWER CONSUMPTION | 14 W | 33 W | 17 W | 22 W |
| CONNECTION I/F | USB2.0 WIRELESS LAN | USB | USB2.0 WIRELESS LAN | USB |
| PRINT FUNCTION | NORMAL PRINTING DIRECT PRINTING NETWORK PRINTING AUTOMATIC DUPLEX PRINTING BORDERLESS PRINTING | NORMAL PRINTING | NORMAL PRINTING DIRECT PRINTING NETWORK PRINTING AUTOMATIC DUPLEX PRINTING BORDERLESS PRINTING LABEL PRINTING | NORMAL PRINTING BORDERLESS PRINTING |
| SIZE (mm) WIDTH×HEIGHT ×DEPTH | 425×147×315 | 396×256×413 | 390×141×339 | 475×235×389 |
| WEIGHT | 6.5 Kg | 7.6 Kg | 6.9 Kg | 7.5 Kg |
| POWER CONSUMPTION RATIO | 42% | 100% | 77% | 100% |
| VOLUME RATIO | 47% | 100% | 43% | 100% |
| WEIGHT RATIO | 86% | 100% | 92% | 100% |

LIQUID EJECTING APPARATUS

This application claims priority to Japanese Patent Application No. 2017-231478 filed on Dec. 1, 2017. The entire disclosure of Japanese Patent Application No. 2017-231478 is hereby incorporated herein by reference.

BACKGROUND

1. Technical Field

The present invention relates to a liquid ejecting apparatus.

2. Related Art

A liquid ejecting apparatus such as an ink jet printer and the like drives a head unit by a drive signal generated by a drive signal generation circuit (an example of a "drive signal generation section") and forms an image on a recording medium by ejecting a liquid such as ink and the like from the head unit. In such a liquid ejecting apparatus, to form an image of stable quality on a recording medium, it is preferable to prevent the liquid ejecting apparatus from being heated to a high temperature.

Therefore, in the related art, a technique is proposed that prevents the temperature of the head unit from exceeding a predetermined upper limit temperature and thus reduces the possibility that liquid ejecting apparatus is heated to a high temperature by stopping ejection of a liquid from the head unit when the temperature of the head unit reaches a predetermined upper limit temperature (for example, refer to JP-A-2014-014934).

By the way, the drive signal for driving the head unit is a signal with a large amplitude, and a drive signal generation circuit generates heat when generating a drive signal. In recent years, along with the downsizing of a liquid ejecting apparatus, downsizing of a circuit board on which a drive signal generation circuit that generates a drive signal is mounted has been underway. As the downsizing of the circuit board advances, heat dissipation efficiency of the heat generated by the drive signal generation circuit through the circuit board declines. Therefore, a problem arises that the possibility that, as the downsizing of the circuit board advances, the drive signal generation circuit is heated to a high temperature and consequently the liquid ejecting apparatus is heated to a high temperature, increases.

SUMMARY

An advantage of some aspects of the invention is to provide a technology that reduces the possibility that a drive signal generation circuit is heated to a high temperature.

According to an aspect of the invention, there is provided a liquid ejecting apparatus that includes a drive signal generation section that generates a drive signal, a head unit that is provided with M (M is a natural number equal to or greater than one) ejection sections driven by the drive signal to eject liquid, the temperature information output section that outputs temperature information indicating a value corresponding to a temperature of predetermined portion of the liquid ejecting apparatus, and a stop control section that decides a time length of a stop period in which the drive signal generation section stops generating the drive signal based on the temperature information.

In this case, generation of the drive signal can be stopped in the drive signal generation section when the temperature of a predetermined portion inside the liquid ejecting apparatus rises to approach a predetermined temperature. Therefore, the drive signal generation section can be prevented from being heated to a high temperature equal to or higher than a predetermined temperature. In this way, compared to the case where a stop period in which generation of the drive signal by the drive signal generation section is stopped is not provided, the possibility that the liquid ejecting apparatus is heated to a high temperature can be reduced.

The liquid ejecting apparatus described above may further include a designation signal output section that outputs a designation signal for designating an ejection section to be driven by the drive signal in a unit period out of the M ejection sections and a drive signal supply section that drives the ejection section designated by the designation signal by supplying the drive signal to an ejection section designated by the designation signal in the unit period, in which the stop control section may decide the time length of the stop period based on a total value of the number of ejection sections designated by one or a plurality of designation signals that the designation signal output section outputs in a print period that includes one or a plurality of unit periods that is started after the end of the stop period.

In this case, the time length of the stop period is decided on the basis of a total value of the number of ejection sections designated by the designation signal. Therefore, the temperature of the drive signal generation section at the end of print period can be prevented from reaching a high temperature equal to or higher the than a predetermined temperature.

In the liquid ejecting apparatus described above, the stop control section may include a temperature estimation section that calculates an estimated temperature that is the temperature at a predetermined portion at the end of the print period based on the temperature information and the total value, a temperature determination section that determines whether or not the estimated temperature is equal to or higher than a predetermined temperature, and a decision section that decides the time length of the stop period based on the estimated temperature when determination result of the temperature determination section is affirmative and decides the time length of the stop period as a predetermined time length when determination result of the temperature determination section is negative.

In this case, the time length of the stop period is decided on the basis of the estimated temperature which is the estimated value of the temperature of the drive signal generation section at the end of the print period. Therefore, the temperature of the drive signal generation section at the end of the print period can be prevented from reaching a high temperature equal to or higher than a predetermined temperature.

In the liquid ejecting apparatus described above, the stop control section may include a reference determination section that determines whether or not a temperature indicated by the temperature information is equal to or higher than the reference temperature, a temperature estimation section that calculates the estimated temperature which is a temperature at the predetermined portion at the end of the print period based on the temperature information and the total value when determination result of the reference determination section is affirmative, a temperature determination section that determines whether or not the estimated temperature is equal to or higher than a predetermined temperature, and a decision section that decides the time length of the stop period based on the estimated temperature when determination result of the temperature determination section is affirmative and decides the time length of the stop period as a predetermined time length when determination result of the reference determination section is negative or when determination result of the temperature determination section is negative.

In this case, the time length of the stop period is decided on the basis of the estimated temperature which is an estimated value of the temperature of the drive signal generation section at the end of the print period. Therefore, the temperature of the drive signal generation section at the end of print period can be prevented from reaching a high temperature equal to or higher than a predetermined temperature.

In the liquid ejecting apparatus described above, the stop control section may decide the time length of the stop period so that the time length of the stop period when the total value is a first value is longer than the time length of the stop period when the total value is a second value which is smaller than the first value.

In this case, the time length of the stop period is decided on the basis of a total value of the number of ejection sections designated by designation signal. Therefore, the temperature of the drive signal generation section at the end of a print period can be prevented from reaching a high temperature equal to or higher than a predetermined temperature.

In the liquid ejecting apparatus described above, the stop control section may include a temperature determination section that determines whether or not a temperature indicated by the temperature information is equal to or higher than a predetermined temperature, and a decision section that decides the time length of the stop period based on the temperature information when determination result of the temperature determination section is affirmative and decides the time length of the stop period as a predetermined time length when determination result of the temperature determination section is negative.

In this case, the time length of a stop period is decided on the basis of the temperature information indicating a temperature of a predetermined portion of the liquid ejecting apparatus. Therefore, compared to the case where the stop period in which generation of the drive signal by the drive signal generation section is stopped is not provided, the possibility that a temperature of the drive signal generation section is heated to a high temperature equal to or higher than a predetermined temperature can be reduced.

In the liquid ejecting apparatus described above, the drive signal generation section and the stop control section may be mounted on a single circuit board.

In this case, the time length of the stop period is decided based on temperature information indicating a temperature of a predetermined portion of the liquid ejecting apparatus. Therefore, compared to the case where the stop period in which generation of the drive signal by the drive signal generation section is stopped is not provided, the possibility that the temperatures of the drive signal generation section and the stop control section reach a high temperature equal to or higher than a predetermined temperature can be reduced.

In the liquid ejecting apparatus described above, the temperature information output section may measure the temperature of the circuit board and output the temperature information indicating the measurement result.

In this case, the time length of the stop period is decided on the basis of temperature information indicating the temperature of the circuit board. Therefore, compared to the case where the stop period in which generation of the drive signal by the drive signal generation section is stopped is not provided, the possibility that the temperature of the circuit board reaches a high temperature equal to or higher than a predetermined temperature can be reduced.

The liquid ejecting apparatus described above may include a scanner unit that reads an image formed on a medium and a scanner drive section that drives the scanner unit, and the stop control section may set the time length of the stop period in a case where the scanner drive section drives the scanner unit longer than the time length of the stop period in a case where the scanner drive section does not drive the scanner unit.

In this case, in a case where scanner unit is driven, the time length of the stop period is set to be longer than in a case where scanner unit is not driven. Therefore, the possibility that the liquid ejecting apparatus is heated to a high temperature can be reduced even when the scanner drive section drives the scanner unit and heat is generated from the scanner drive section.

In the liquid ejecting apparatus described above, the drive signal generation section, the stop control section and the scanner drive section may be mounted on a single circuit board.

In this case, the possibility that the temperature of the circuit board reaches a high temperature equal to or higher than a predetermined temperature can be reduced even when the scanner drive section drives the scanner unit and heat is generated from the scanner drive section.

BRIEF DESCRIPTION OF THE DRAWINGS

The invention will be described with reference to the accompanying drawings, wherein like numbers reference like elements.

FIG. 9 is a descriptive diagram for describing an example of features of the ink jet printer released in recent years.

DESCRIPTION OF EXEMPLARY EMBODIMENTS

Hereinafter, embodiments of the invention will be described with reference to the figures. However, in each figure, the dimension and the scale of each part are made to be different from the actual ones as deemed appropriate. Further, since the embodiments described below are preferable specific examples of the invention, various technically preferable limitations are attached. However, the scope of the invention is not limited to these forms unless otherwise stated to limit the invention in particular.

A. EMBODIMENT

In this embodiment, a liquid ejecting apparatus will be described with an example of an ink jet printer that forms an image on recording paper P (an example of "recording medium") by ejecting ink (an example of "liquid").

1. Overview of Ink Jet Printer

Hereinafter, with reference to FIGS. 1 and 2, configuration of an ink jet printer 1 according to the embodiment will be described.

Figure 1:
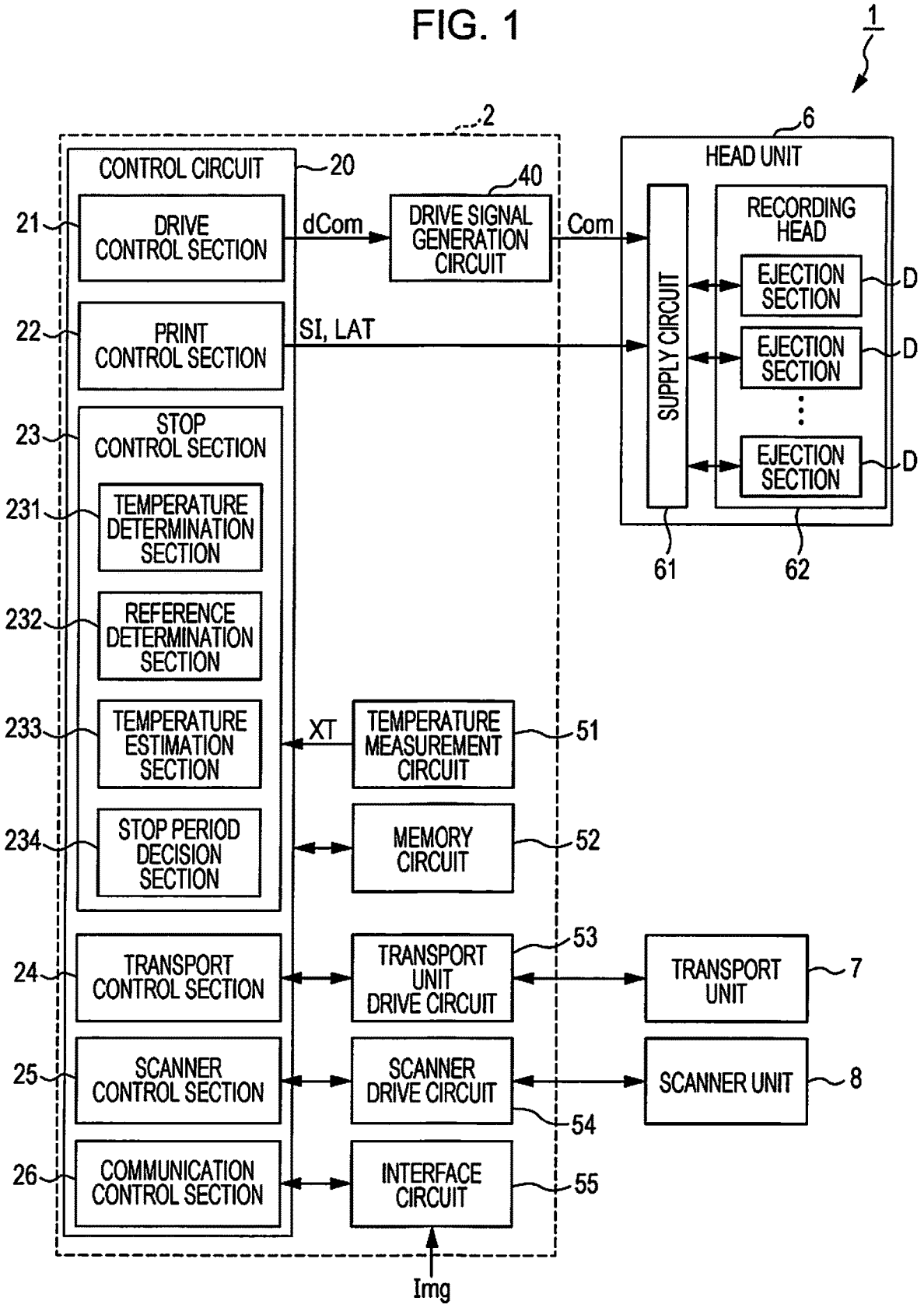
FIG. 1 is a block diagram illustrating an example of configuration of an ink jet printer according to the invention.

FIG. 1 is a functional block diagram illustrating an example of the configuration of the ink jet printer 1. The ink jet printer 1 is supplied with the print data Img from a host computer (not illustrated) such as a personal computer, a digital camera, or the like, which indicates an image which the ink jet printer 1 has to form and copy number information CP which indicates the number of prints of an image which the ink jet printer 1 has to form.

According to the embodiment, the ink jet printer 1 may perform a printing process of forming an image indicated by the print data Img which is supplied from a host computer on a recording paper P. Further, according to the embodiment, the ink jet printer 1 may also perform a reading process of reading an image formed on the recording paper P.

As illustrated in FIG. 1, the ink jet printer 1 includes the control unit 2, the head unit 6 provided with the ejection section D that ejects ink, the transport unit 7 for changing a relative position of the recording paper P with respect to the head unit 6, and the scanner unit 8 for reading an image formed on the recording paper P. In the embodiment, as an example, it is assumed that the control unit 2, the head unit 6, the transport unit 7, and the scanner unit 8 are formed inside the casing 100 (refer to FIG. 2) of the ink jet printer 1.

In the embodiment, a case where the ink jet printer 1 includes the control unit 2, the head unit 6, the transport unit 7 and the scanner unit 8 will be described as an example. However, the invention is not limited to such an aspect. The ink jet printer 1 may include the control unit 2, the head unit 6, and the transport unit 7 at least.

The head unit 6 includes the recording head 62 that includes the M ejection sections D and the supply circuit 61 (an example of the "drive signal supply section") that switches between supply and no-supply of the drive signal Com for the driving ejection section D to the recording head 62 (in this embodiment, M is a natural number satisfying $1 \leq M$).

Hereinafter, to distinguish each of the M ejection sections D provided in the recording head 62, each will be referred to as stage 1, stage 2, . . . , and stage M in order. Further, the ejection section D of the stage m will be referred to as the ejection section D[m] (the variable m being a natural number satisfying $1 \leq m \leq M$). Further, when the constituent elements, the signals, and the like of the ink jet printer 1 correspond to the stage m of the ejection section D[m], suffix [m] may be appended to the symbols for representing the constituent elements, the signals and the like, to express correspondence to the stage m.

Further, hereinafter, the drive signal Com supplied to the ejection section D among the drive signals Com may be referred to as the supply drive signal Vin in some cases. Further, the supply drive signal Vin supplied to the ejection section D[m] may be referred to as the supply drive signal Vin[m] in some cases.

The Control unit 2 includes the control circuit 20 that controls the operation of each section of the ink jet printer 1, the drive signal generation circuit 40 (an example of the "drive signal generation section") that generates the drive signal Com, the temperature measurement circuit 51 for measuring the temperature inside the ink jet printer 1, the memory circuit 52 for storing various information, the transport unit drive circuit 53 for driving transport unit 7, the scanner drive circuit 54 (an example of the "scanner drive section") for driving the scanner unit 8, and the interface circuit 55 for performing communication with the outside of the ink jet printer 1.

Further, in the embodiment, as an example, it is assumed that each constituent element of the control unit 2(the control circuit 20, the drive signal generation circuit 40, the temperature measurement circuit 51, the memory circuit 52, the transport unit drive circuit 53, the scanner drive circuit 54, and the interface circuit 55) is formed on the substrate 200 (an example of the "circuit board", refer to FIG. 2) provided inside the casing 100.

The temperature measurement circuit 51 includes the thermistor TM (not illustrated) that measures the temperature and outputs the temperature information XT that indicates the temperature measured by the thermistor TM. That is, the temperature measurement circuit 51 is an example of the "temperature information output section" that outputs the temperature information XT. In the embodiment, as an example, it is assumed the thermistor TM is provided on the substrate 200. That is, in the embodiment, as an example, it is assumed that the "predetermined portion" which is a measurement target of the temperature by the temperature measurement circuit 51 is a position where the thermistor TM is provided on the substrate 200.

The memory circuit 52 is configured to include one or both of a volatile memory such as a random access memory (RAM) and a nonvolatile memory such as read-only memory (ROM), electrically erasable programmable read-only memory (EEPROM), or programmable ROM (PROM), or the like, and stores the print data Img supplied from the host computer and various information such as a control program and the like of the ink jet printer 1.

The control circuit 20 is configured to include a central processing unit (CPU). However, the control circuit 20 may include a programmable logic device such as field-programmable gate array (FPGA) and the like in place of, or in addition to, the CPU.

By operating according to the control program stored in the memory circuit 52 and executed by the CPU provided in the control circuit 20, the control circuit 20 may function as the drive control section 21, the print control section 22, the stop control section 23, the transport control section 24, the scanner control section 25, and the communication control section 26.

The drive control section 21 generates the waveform designation signal dCom for controlling the drive signal generation circuit 40. The waveform designation signal dCom is a digital signal that designates the waveform of drive signal Com. When the waveform designation signal dCom is supplied from the drive control section 21, the drive signal generation circuit 40 generates the drive signal Com which is an analog signal having a waveform designated the by waveform designation signal dCom.

The print control section 22 generates the print signal SI for controlling the head unit 6 and the latch signal LAT for informing the head unit 6 of start of the printing process. Here, the print signal SI is a digital signal for designating a type of operation of the ejection section D. Specifically, the print signal SI designate a type of operation of each of the ejection section D by deciding whether or not to supply the drive signal Com to each of the ejection section D. That is, the print signal SI is an example of the "designation signal" that designates the ejection section D to be driven by the drive signal Com. Further, the print control section 22 is an example of a "designation signal output section" that outputs a "designation signal".

Further, designation of the type of operation of ejection section D, for example, is a designation as to whether or not the ejection section D is to be driven, a designation as to whether or not ink is to be ejected from the ejection section D when the ejection section D is driven, or a designation of the amount of ink to be ejected from the ejection section D when the ejection section D is driven.

The stop control section 23 includes the temperature determination section 231, the reference determination section 232, the temperature estimation section 233, and the stop period decision section 234 (an example of the "decision section"), and executes a stop period decision process which is a process of deciding the time length of the stop period Wt in which the drive signal generation circuit 40 stops generating the drive signal Com based on the temperature information XT output by the temperature measurement circuit 51. The temperature determination section 231, the reference determination section 232, the temperature estimation section 233, and the stop period decision section 234 will be described below.

The transport control section 24 outputs a signal for controlling transport the unit drive circuit 53.

The scanner control section 25 outputs a signal for controlling the scanner drive circuit 54.

The communication control section 26 controls execution of communication with an external device that exists outside the ink jet printer 1 via the interface circuit 55.

When printing process is executed, the communication control section 26 first obtains the print data Img supplied from host computer via the interface circuit 55 and stores the obtained the print data Img in the memory circuit 52. Next, the print control section 22 generates the print signal SI based on the print data Img stored in the memory circuit 52 and stores the generated print signal SI in the memory circuit 52. Then, the print control section 22 supplies the print signal SI and the latch signal LAT stored in the memory circuit 52 to the supply circuit 61. The drive control section 21 outputs the drive signal Com from the drive signal generation circuit 40 by supplying the waveform designation signal dCom to the drive signal generation circuit 40. Further, the transport control section 24 controls the transport unit drive circuit 53 to change the relative position of the recording paper P with respect to the head unit 6.

In this way, the ink jet printer 1 adjusts the presence and absence of the ejection of ink from the ejection section D, the ejection amount of ink, the ejection timing of ink, and the landing position of ink on the recording paper P and the like under control of the control circuit 20 and executes the printing process of forming an image corresponding to the print data Img on the recording paper P.

One or a plurality of printing processes executed to form an image indicated by the print data Img is referred to as a print task. Further, one or a plurality of print tasks executed to form the image indicated by the print data Img for the number of copies corresponding to the copy number information CP is referred to as a print job.

When reading process is executed, the scanner control section 25 controls the scanner drive circuit 54 so that the scanner unit 8 reads the image recorded on the recording paper P and outputs the image data Dat indicating the read image. Then, the scanner control section 25 stores the image data Dat output from the scanner unit 8 in the memory circuit 52.

Figure 2:
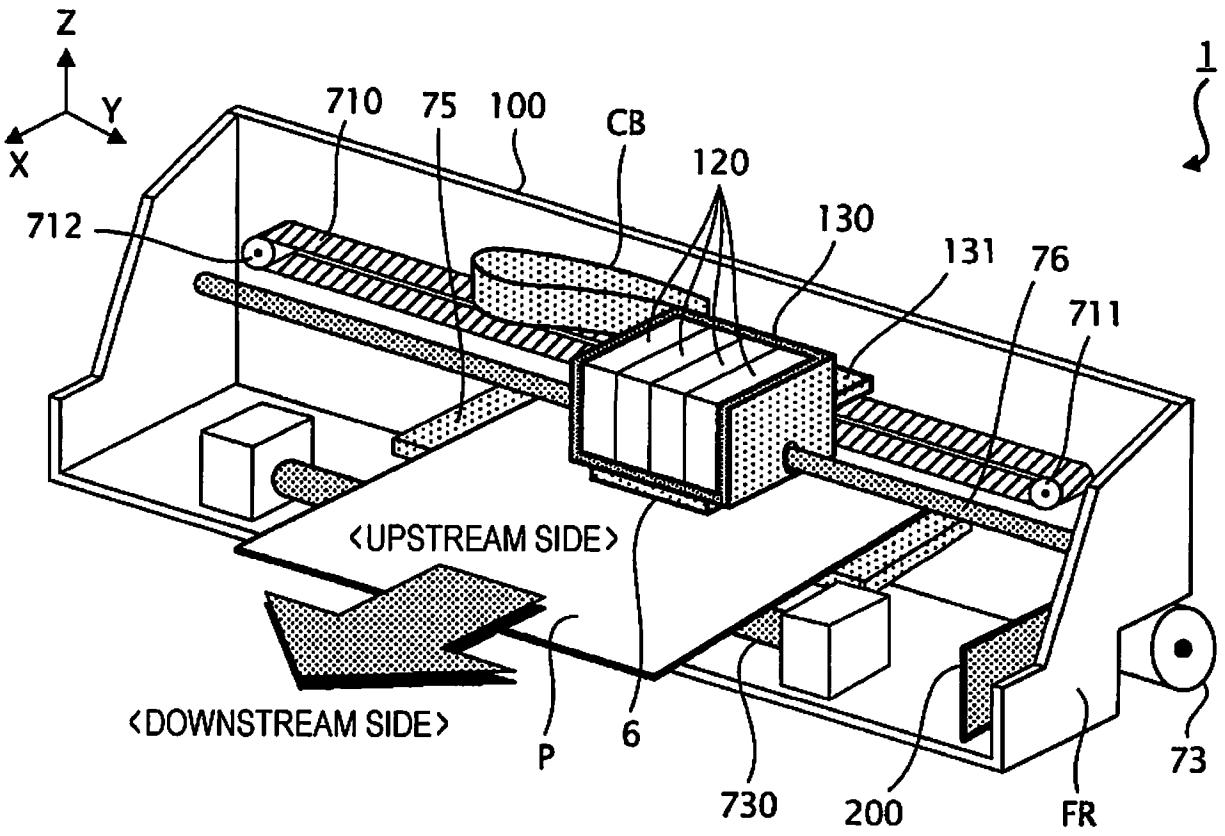
FIG. 2 is a perspective view illustrating an example of schematic inside structure of the ink jet printer.

FIG. 2 is a perspective view illustrating an example of schematic internal structure of the ink jet printer 1.

As illustrated in FIG. 2, in the embodiment, it is assumed that the ink jet printer 1 is a serial printer. Specifically, when the ink jet printer 1 executes printing process, while transporting the recording paper P in the sub-scanning direction, the ink jet printer 1 forms dots corresponding to the print data Img on the recording paper P by ejecting ink from the ejection section D while letting the head unit 6 reciprocate in the main scanning direction which intersects with the sub-scanning direction.

Hereinafter, the +X direction and the −X direction which is the direction opposite thereto will be collectively referred to as the "X-axis direction", the +Y direction and the −Y direction which is the direction opposite thereto will be collectively referred to as the "Y-axis direction", and the +Z direction and the −Z direction which is the direction opposite thereto will be collectively referred to as the "Z-axis direction." In the embodiment, as illustrated in FIG. 2, the direction from the −X side (upstream side) toward the +X side (downstream side) is set as sub-scanning direction, and the Y-axis direction is set as the main scanning direction. In the embodiment, for example, the X-axis direction, the Y-axis direction and the Z-axis direction are assumed to be orthogonal to one another. However, the X-axis direction, the Y-axis direction and the Z-axis directions may be the directions intersecting one another.

As illustrated in FIG. 2, according to the embodiment, the ink jet printer 1 includes the casing 100, the carriage 130 which may reciprocate in the Y-axis direction (main scanning direction) inside the casing 100 and on which the head unit 6 is mounted, and the substrate 200 on which various constituent elements of the control unit 2 are mounted.

Further, as described above, according to the embodiment, the ink jet printer 1 includes the transport unit 7.

When the printing process is executed, the transport unit 7 changes the relative position of the recording paper P with respect to the head unit 6 by transporting the recording paper P in the +X direction while the carriage 130 reciprocates in the Y-axis direction, and landing of ink on the entire recording paper P is possible.

The transport unit 7 includes a transport motor (not illustrated) serving as a driving source for the driving carriage 130 to reciprocate, the paper feed motor 73 serving as a driving source for transporting the recording paper P, the carriage guide shaft 76 that extend in the Y-axis direction, and the timing belt 710 that extends in the Y-axis direction, winding around the pulley 711 driven to rotate by the transport motor and the rotatable pulley 712. While being reciprocally supported in the Y-axis direction by the carriage guide shaft 76, the carriage 130 is fixed to a predetermined position of the timing belt 710 via the fixing tool 131. Therefore, by driving the pulley 711 to rotate by the transport motor, the transport unit 7 may reciprocate the carriage 130 along the carriage guide shaft 76 in the Y-axis direction together with the head unit 6.

Further, as illustrated in FIG. 2, the transport unit 7 includes the platen 75 provided on the lower side (−Z side) of the carriage 130, the paper feed roller (not illustrated) for feeding the recording paper P sheet by sheet to the platen 75 by rotating according to driving of the paper feed motor 73, and the paper discharge roller 730 that transports recording paper P on the platen 75 to a paper discharge port by rotating according to driving of the paper feed motor 73. Therefore, the transport unit 7 may transport the recording paper P from the −X side (upstream side) to the +X side (downstream side) on the platen 75 as illustrated in FIG. 2.

In the embodiment, as illustrated in FIG. 2, the four ink cartridges 120 are mounted on the carriage 130 of the ink jet printer 1. More specifically, in the embodiment, as an example, it is assumed that the four ink cartridges 120 that correspond one to one to ink of the four colors (CMYK) of cyan, magenta, yellow and black are mounted on the carriage 130.

Further, in the embodiment, as an example, it is assumed that the M ejection sections D are divided into four groups corresponding to the four ink cartridges 120 one to one. Each of the ejection section D is supplied with ink from the ink cartridge 120 that corresponds to the group to which the ejection section D belongs. In this way, each of the ejection section D may fill the inside thereof with the ink supplied and eject the filled ink from the nozzle N (refer to FIG. 3). That is, the total of the M ejection sections D provided in the head unit 6 may eject ink of the four colors of CMYK as a whole.

Further, FIG. 2 is no more than an example, and the ink cartridge 120 may be provided outside the carriage 130.

2. Outline of Recording Head and Ejection Section

The recording head 62 and the ejection section D provided in the recording head 62 will be described with reference to FIGS. 3, and 4.

Figure 3:
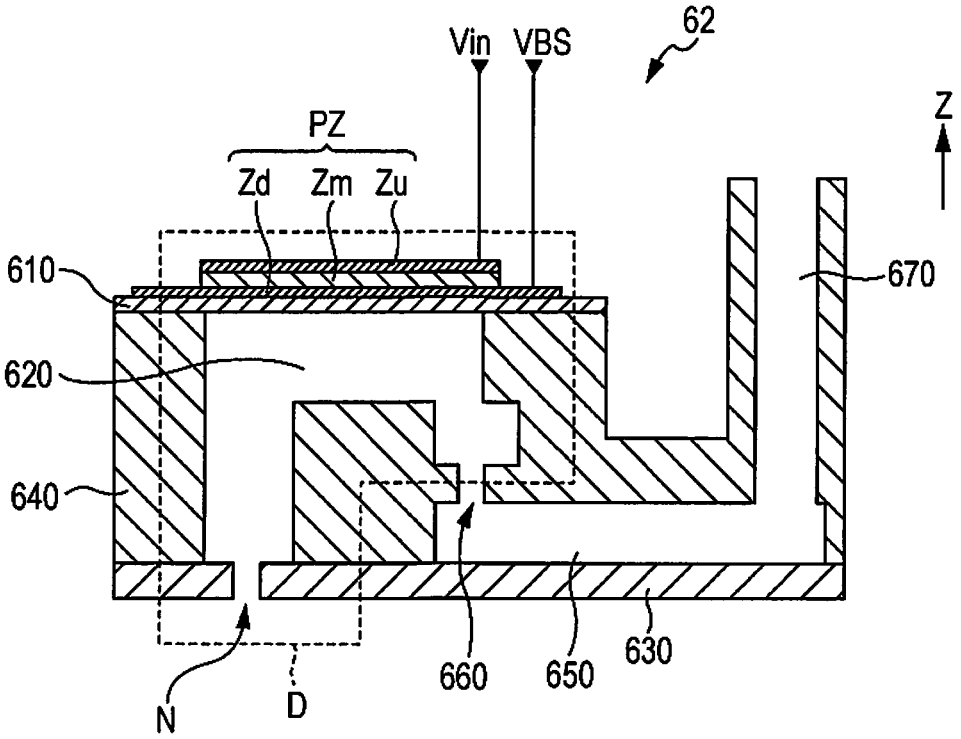
FIG. 3 is a descriptive diagram for describing an example of structure of an ejection section.

FIG. 3 is a part of schematic sectional view of the recording head 62 cut so as to include the ejection section D.

As illustrated in FIG. 3, the ejection section D includes the piezoelectric element PZ, the cavity 620 which is filled with ink inside, the nozzle N communicating with the cavity 620, and the diaphragm 610. With supply of the supply drive signal Vin to the piezoelectric element PZ, the Piezoelectric element PZ is driven by the supply drive signal Vin, by which the ejection section D ejects ink in the cavity 620 from the nozzle N. The cavity 620 is a space partitioned by the cavity plate 640, the nozzle plate 630 on which the nozzle N is formed, and the diaphragm 610. The cavity 620 communicates with the reservoir 650 via the ink supply port 660. The reservoir 650 communicates with the ink cartridge 120 that corresponds to the ejection section D via the ink inlet 670.

In the embodiment, a unimorphic (monomorphic) type as illustrated in FIG. 3 is adopted as the piezoelectric element PZ. The piezoelectric element PZ is not limited to a unimorphic type, but a bimorph type, a lamination type, or the like may be adopted.

The piezoelectric element PZ includes the upper electrode Zu, the lower electrode Zd and the piezoelectric body Zm provided between the upper electrode Zu and the lower electrode Zd. The lower electrode Zd is electrically connected with the power supply line LHd (refer to FIG. 5) set at power supply potential VBS on a low potential side. Then, when the drive signal Com (supply drive signal Vin) is supplied to the upper electrode Zu and a voltage is applied between the upper electrode Zu and the lower electrode Zd, the piezoelectric element PZ is displaced in the +Z direction or the −Z direction according to the applied voltage, and, as a result, the piezoelectric element PZ vibrates.

The diaphragm 610 is installed in an upper surface opening of the cavity plate 640. The lower electrode Zd is bonded to the diaphragm 610. Therefore, when the piezoelectric element PZ, driven by the supply drive signal Vin, is displaced, the diaphragm 610 is also displaced. Then, volume of the cavity 620 changes by the displacement of the diaphragm 610, and the ink that filled the cavity 620 is ejected from the nozzle N.

Figure 4:
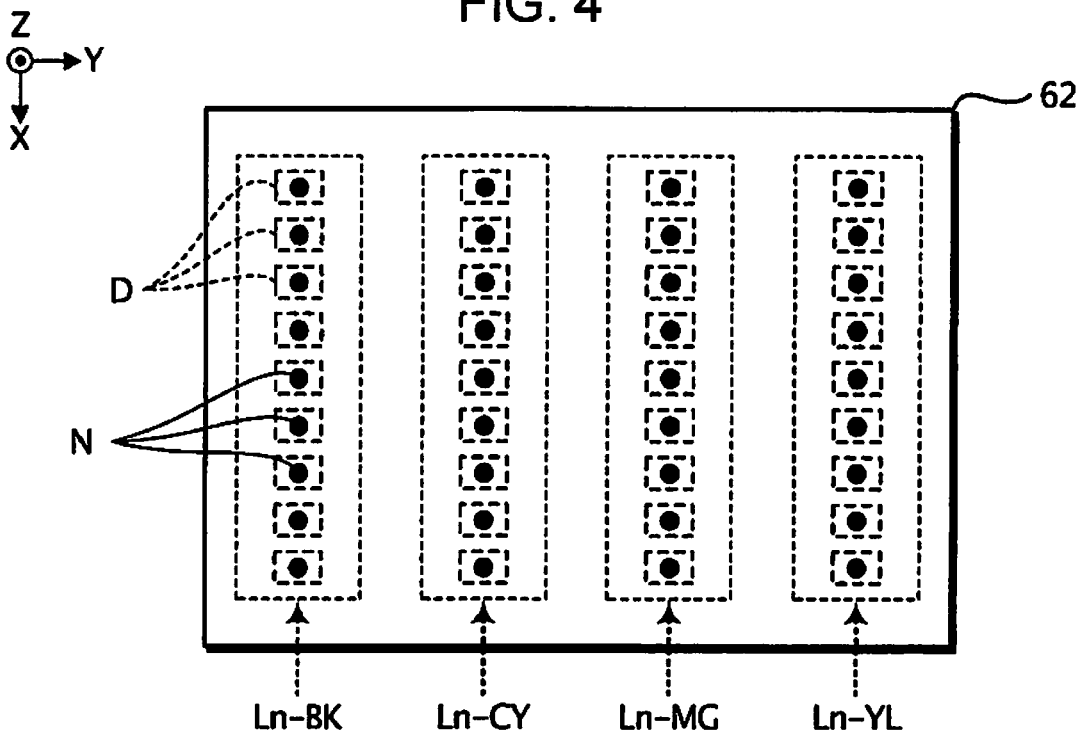
FIG. 4 is a plan view illustrating an example of disposition of a nozzle N in a recording head.

FIG. 4 is a descriptive diagram for describing an example of an arrangement of the M pieces of nozzles N provided in the recording head 62 when the ink jet printer 1 is viewed from the +Z direction or the −Z direction in a plan view.

As illustrated in FIG. 4, the four nozzle rows Ln are provided in recording head 62. Here, the nozzle row Ln is a plurality of the nozzles N arranged to extend in a row in a predetermined direction. In the embodiment, as an example, it is assumed that each of the nozzle row Ln is composed of a plurality of the nozzles N that extend in a row in the X-axis direction.

Hereinafter, each of the four nozzle rows Ln provided in the recording head 62 will be referred to as the nozzle rows Ln-BK, Ln-CY, Ln-MG, and Ln-YL. Here, the nozzle row Ln-BK is the nozzle row Ln in which the nozzles N of the ejection section D that eject black ink are arranged, the nozzle row Ln-CY is the nozzle row Ln in which the nozzles N of the ejection section D that ejects cyan ink are arranged, the nozzle row Ln-MG is the nozzle row Ln in which the nozzles N of the ejection section D that ejects magenta ink are arranged, and the nozzle Ln-YL is the nozzle row Ln in which the nozzles N of the ejection section D that ejects yellow ink are arranged.

However, nozzle row Ln illustrated in FIG. 4 is an example, and the plurality of the nozzles N belonging to each of the nozzle row Ln may be arranged with a predetermined distance therebetween in a direction intersecting with the direction in which the nozzle row Ln extends. That is, in each of the nozzle row Ln, a plurality of the nozzles N belonging to each nozzle row Ln may be arranged in a zigzag manner so that the positions of the even-numbered nozzle N and the odd-numbered nozzle N from the +X side are different in the Y-axis direction. Further, each of the nozzle row Ln may extend in a direction different from the X-axis direction. Further, in the embodiment, an exemplary case where the number of rows of the nozzle row Ln provided in the recording head 62 is "four" is illustrated, but one or more rows of the nozzles Ln may be provided in the recording head 62.

3. Outline of Head Unit

Hereinafter, the configuration and the operation of the head unit 6 will be described with reference to FIGS. 5 to 7.

Figure 5:
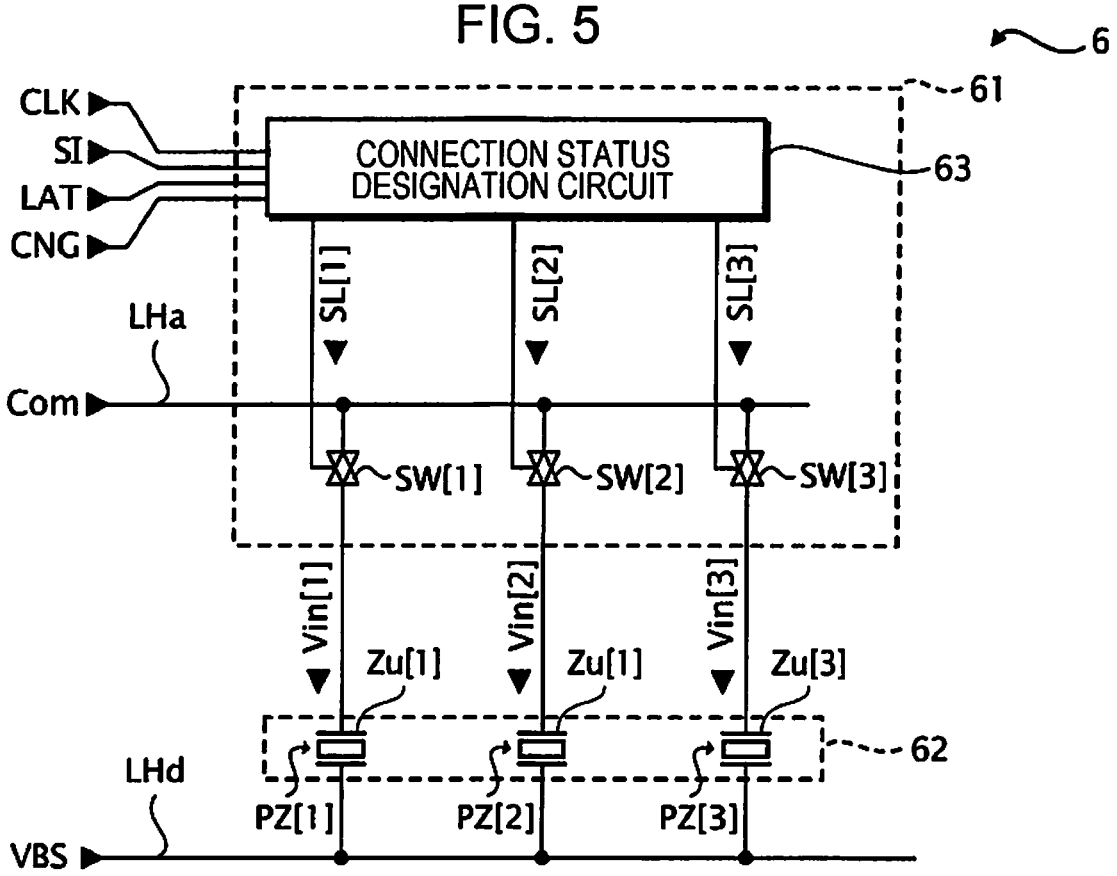
FIG. 5 is a block diagram illustrating an example of configuration of a head unit.

FIG. 5 is a block diagram illustrating an example of the configuration of the head unit 6. The head unit 6 includes the recording head 62, the supply circuit 61, the wiring LHa and the power supply line LHd.

The supply circuit 61 includes the M switches SW (SW[1] to SW[M]) and the connection status designation circuit 63 that designates connection status of each of the switch SW. For example, a transmission gate may be employed as each of the switch SW. In FIG. 5, for simplicity, only three switches SW are illustrated.

The connection status designation circuit 63 generates the connection status designation signals SL[1] to SL[M] that designate on/off of the switches SW[1] to SW[M] based on at least a part of the signals of the clock signal CLK supplied from the print control section 22, the print signal SI, the latch signal LAT, and the change signal CNG.

The switch SW[m] turns on and off conduction between the wiring LHa and the upper electrode Zu[m] of the piezoelectric element PZ[m] provided in the ejection section D[m] according to the connection status designation signal SL[m]. For example, the switch SW[m] is turned on when the connection status designation signal SL[m] is at a high level, and is turned off when the connection status designation signal SL[m] is at a low level. As described above, out of the drive signal Com, the signal supplied to the piezoelectric element PZ[m] of the ejection section D[m] via the switch SW[m] is the supply drive signal Vin[m].

In the embodiment, operation period of the ink jet printer 1 includes one or a plurality of unit periods Tu. The ink jet printer 1 may drive each of the ejection section D for printing process in each of the unit period Tu. Then, by executing printing process in a plurality of the unit periods Tu provided continuously or intermittently, the ink jet printer 1 ejects ink once or a plurality of times from each of the ejection section D, for example, and forms an image indicated by the print data Img.

Further, in the embodiment, it is assumed as an example that, out of operation periods of the ink jet printer 1, the period in which one print task is executed for forming one image indicated by the print data Img includes a plurality of the main scanning period Ws and a plurality of the stop periods Wt.

Here, main scanning period Ws is a period which is decided on the basis of the width Yp of the recording paper P in main scanning direction (Y-axis direction). Specifically, the main scanning period Ws is a period in which the head unit 6 moves in the main scanning direction and traverses the recording paper P upward (+Z side), and a period in which ink may land on the recording paper P from a part or all of the M ejection sections D provided in the head unit 6.

In the embodiment, the main scanning period Ws is a generic term for the forward path main scanning period Ws1 and the backward path main scanning period Ws2. Here, the forward path main scanning period Ws1 is a period after the head unit 6 starts to move from the −Y side of the recording paper P on the platen 75 in the +Y direction and is a period from the time when ink may land on the recording paper P from at least a part of the M ejection sections D up to the time when the head unit 6 reaches the +Y side of the recording paper P and ink may not land on the recording paper P from any of the ejection sections D. Further, the backward path main scanning period Ws2 is a period after the head unit 6 starts to move from the +Y side of the recording paper P on the platen 75 in the −Y direction, and is a period from the time when ink may land on the recording paper P from at least a part of the M ejection sections D up to the time when the head unit 6 reaches the −Y side of the recording paper P and ink may not land on the recording paper P from any of the ejection sections D.

Further, in the embodiment, it is assumed that each of the main scanning period Ws includes the Q unit periods Tu. Here, "Q" is a natural number that satisfies 1≥Q and is decided on the basis of the width Yp. That is, in the embodiment, the main scanning period Ws is an example of the "print period."

Further, the stop period Wt is a part or all of the period out of the period from the end of one main scanning period Ws up to the start of another main scanning period Ws that first starts after the end of the main scanning period Ws. More specifically, the stop period Wt is, for example, a generic term for the period in which the recording head 62 is positioned further on the +Y side than the recording paper P on the platen 75 and the period in which the recording head 62 is positioned further on −Y side than recording paper P on the platen 75. In the embodiment, a case is assumed where the transport unit 7 transports the recording paper P from the −X side to the +X side in the stop period Wt. Further, in the embodiment, it is assumed as an example that the stop control section 23 stops generation of the drive signal Com in the drive signal generation circuit 40 and stops ejection of ink from the head unit 6 in the stop period Wt.

In the embodiment, before a start of one main scanning period Ws, the print control section 22, generates Q print signals SI to be supplied to Q supply circuits 61 in the Q unit periods Tu which are included in the one main scanning period Ws, and stores the generated Q print signals SI in the memory circuit 52. Hereinafter, the information indicated by the Q print signals SI to be supplied to the supply circuit 61 in the main scanning period Ws will be referred to as the main scanning print information SIW sometimes.

Further, in the embodiment, the print signal SI supplied to the supply circuit 61 in the unit period Tu includes the individual designation signal Sd[m] for designating the type of operation of the ejection section D[m] in the unit period Tu. In other words, the print signal SI supplied to the supply circuit 61 in the unit period Tu includes M individual designation signals Sd[1] to Sd[M] for designating the type of operations of the ejection sections D[1] to D[M] in the unit period Tu. That is, the main scanning print information SIW includes the (Q×M) individual designation signals Sd(m) for designating the type of operations of the ejection sections D[1] to D[M] in the Q unit periods Tu included in the main scanning period Ws.

In the embodiment, stop control section 23 decides start time of the main scanning period Ws based on Q print signals SI supplied to supply circuit 61 in the main scanning period Ws. In other words, based on the main scanning print information SIW supplied to the supply circuit 61 in the main scanning period Ws, the main scanning period stop control section 23 decides the time length of the stop period Wt that ends before the start of the main scanning period Ws.

Figures 6, 7:
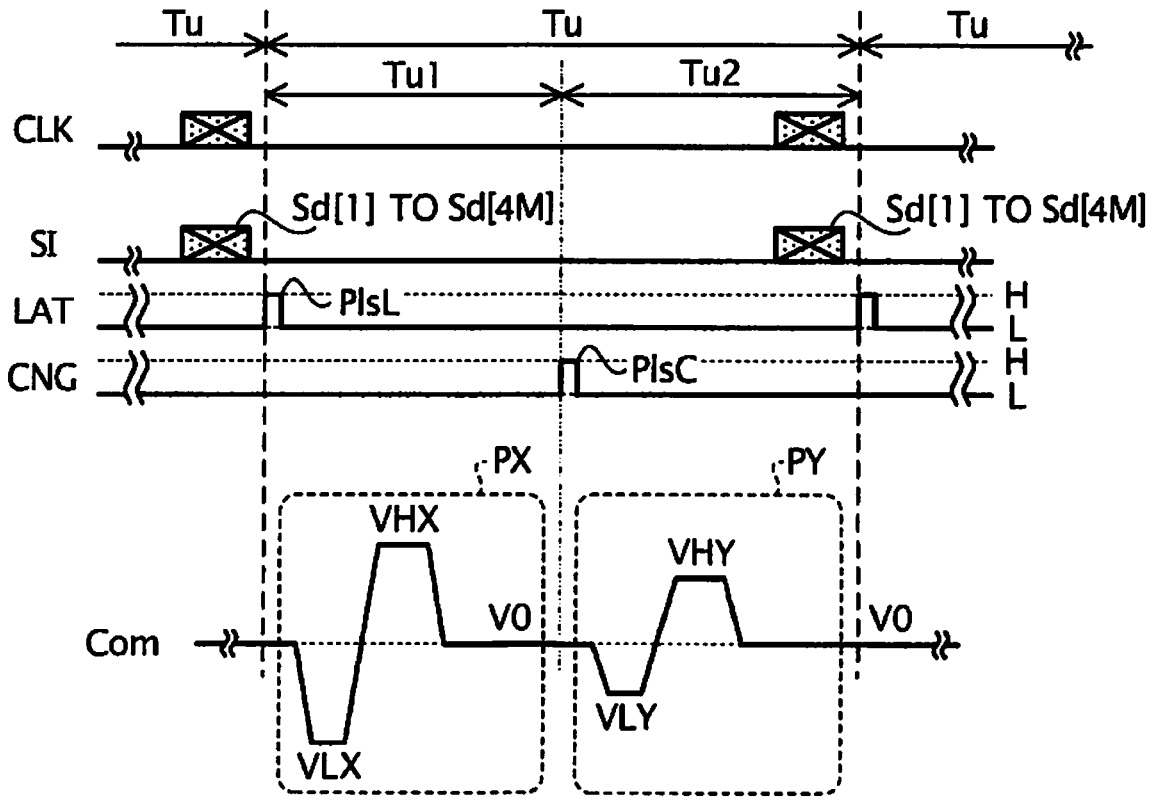
FIG. 6 is a timing chart illustrating an example of an operation of the ink jet printer in the printing process.
FIG. 7 is a descriptive diagram to describe an example of the connection status designation signal SL[m].

FIG. 6 is a timing chart illustrating an example of operation of the ink jet printer 1 in the unit period Tu.

As illustrated in FIG. 6 the print control section 22 outputs the latch signal LAT having the pulse PlsL. In this way, the print control section 22 defines the unit period Tu as a period from the rise of the pulse PlsL to the rise of the next pulse PlsL. Further, the print control section 22 outputs the change signal CNG having the pulse PlsC. In this way, the print control section 22 divides the unit period Tu into control period Tu1 from the rise of the pulse PlsL to the rise of the pulse PlsC and the control period Tu2 from the rise of the pulse PlsC to the rise of the pulse PlsL.

When printing process is executed in the unit period Tu, the print control section 22 supplies the print signal SI that includes the individual designation signals Sd[1] to Sd[M] to the connection status designation circuit 63 in synchronization with the clock signal CLK before the unit period Tu. In this case, the connection status designation circuit 63 generates the connection status designation signal SL[m] based on the individual designation signal Sd[m] in the unit period Tu.

As illustrated in FIG. 6, the drive signal Com includes waveform PX provided in the control period Tu1 and the waveform PY provided in the control period Tu2. In the embodiment, the waveform PX and the waveform PY are decided so that the potential difference between the highest potential VHX and the lowest potential VLX of the waveform PX is greater than the potential difference between the highest potential VHY and the lowest potential VLY of the waveform PY. Specifically, when the ejection section D[m] is driven by the drive signal Com having waveform PX, waveform of the waveform PX is decided so that the amount of ink equivalent to a medium dot (a moderate amount) is ejected from the ejection section D[m]. Further, when the ejection section D[m] is driven by the drive signal Com having waveform PY, waveform of the waveform PY is decided so that the amount of ink equivalent to a small dot (a small amount) is ejected from the ejection section D[m]. In the waveform PX and the waveform PY, the potentials at the start and the end are set to the reference potential V0.

FIG. 7 is a descriptive diagram for describing a relationship between the individual designation signal Sd[m] and the connection status designation signal SL[m].

As illustrated in FIG. 7, in the embodiment, it is assumed that the individual designation signal Sd[m] is a two-bit digital signal. Specifically, in each of the unit period Tu, the individual designation signal Sd[m] sets any one of the four values for the ejection section D[m]: value (1, 1) that designates ejection of ink in the amount (a large amount) equivalent to a large dot (the ejection being referred to as "formation of large dot" sometimes), value (1, 0) that designates ejection of ink in a moderate amount (referred to as "formation of a medium dot" sometimes), value (0, 1) that designates ejection of ink in a small amount (referred to as "formation of a small dot" sometimes), and value (0, 0) that designate no-ejection.

When the individual designation signal Sd[m] is set to the value (1, 1) that designates the formation of a large dot, the connection status designation circuit 63 sets the connection status designation signal SL[m]to a high level in the control periods Tu1 and Tu2. In this case, the ejection section DM, driven by drive the drive signal Com of the waveform PX in the control periods Tu1, ejects ink in a moderate amount, and, driven by the drive signal Com of the waveform PY in the control period Tu2, ejects ink in a small amount. In this way, the ejection section D[m] ejects a large amount of ink in the unit period Tu, and a large dot is formed on the recording paper P.

When the individual designation signal Sd[m] is set to the value (1, 0) that designates the formation of a medium dot, the connection status designation circuit 63 sets the connection status designation signal SL[m] to a high level in the control period Tu1 and to a low level in the control period Tu2 respectively. In this case, the ejection section DM ejects ink in a moderate amount in unit period Tu, and a medium dot is formed on the recording paper P.

When the individual designation signal Sd[m] is set to the value (0, 1) that designates the formation of a small dot, the connection status designation circuit 63 sets the connection status designation signal SL[m] at a low level in the control period Tu1 and at a high level in the control period Tu2 respectively. In this case, the ejection section DM ejects ink in a small amount in the unit period Tu, and a small dot is formed on the recording paper P.

When the individual designation signal Sd[m] is set to the value (0, 0) that designates no-ejection, the connection status designation circuit 63 sets the connection status designation signal SL[m] at a low level in the control periods Tu1 and Tu2. In this case, the ejection section D[m] does not eject ink in the unit period Tu, and no dot is formed on the recording paper P.

4. Stop Period Decision Process

A stop period decision process will be described with reference to FIG. 8.

Figure 8:
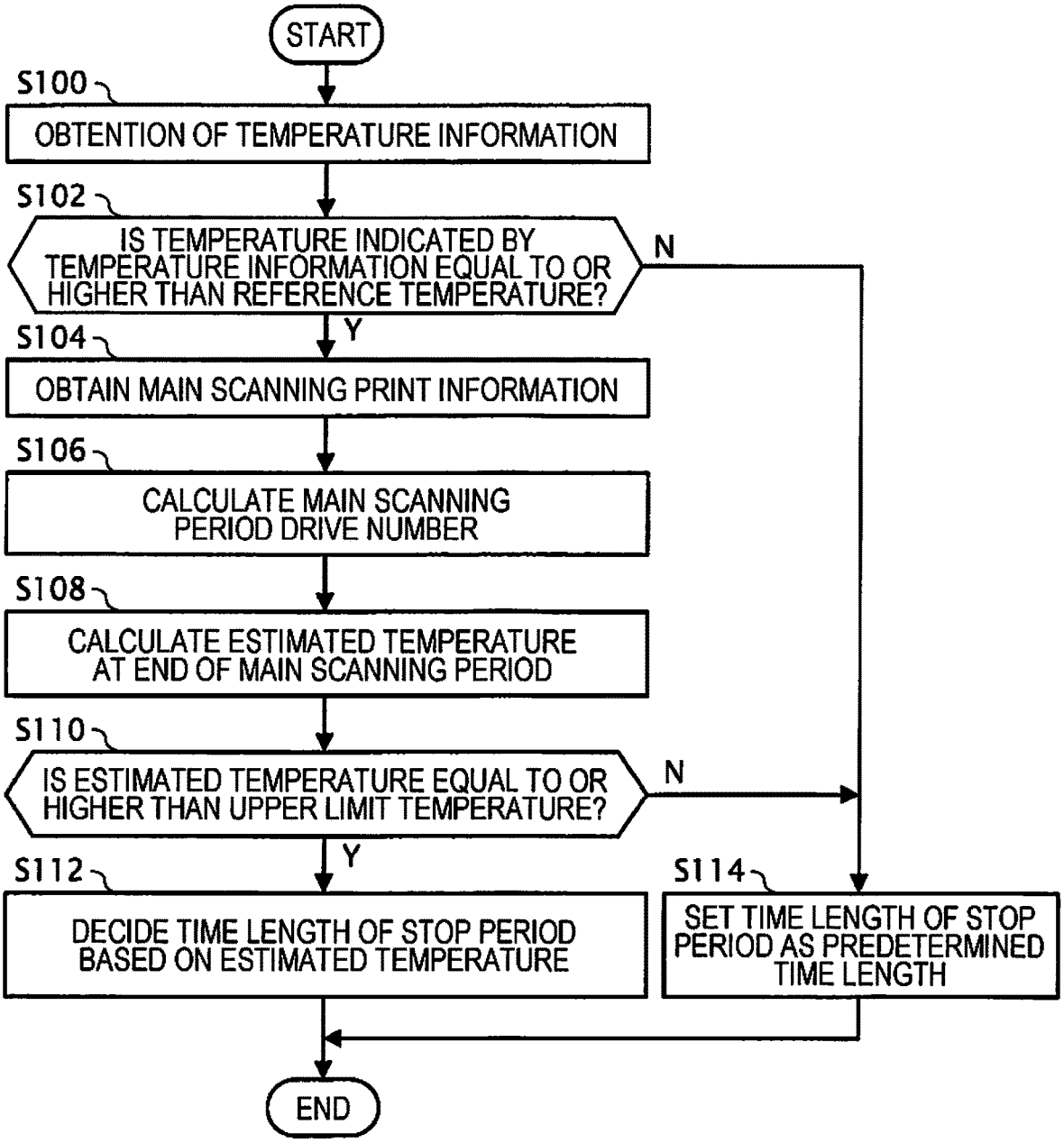
FIG. 8 is a timing chart illustrating an example of the operation of the ink jet printer in the stop period decision process.

FIG. 8 is a flowchart illustrating an operation of the ink jet printer 1 when the ink jet printer 1 executes the stop period decision process. The ink jet printer 1 executes a stop period decision process illustrated in FIG. 8 when one main scanning period Ws is over. As described above, the stop period decision process decides the time length of one stop period Wt that starts after the end of one main scanning period Ws, and, in this way, decides start time of another main scanning period Ws that starts after the end of one stop period Wt.

As illustrated in FIG. 8, when the stop period decision process starts, the stop control section 23 first obtains temperature information XT that the temperature measurement circuit 51 outputs (S100).

Next, the reference determination section 232 of the stop control section 23 determines whether or not the temperature indicated by the temperature information XT obtained in the step S100 is equal to or higher than the reference temperature H0 set in advance (S102).

When result of determination in the step S102 is affirmative, the temperature estimation section 233 of the stop control section 23 obtains the main scanning print information SIW, which is information indicated by the Q print signals SI supplied to the supply circuit 61 in the other main scanning period Ws from the memory circuit 52 (S104).

Then, based on the main scanning print information SIW obtained in the step S104, the temperature estimation section 233 of the stop control section 23 calculates the main scanning period drive number Ks (an example of the "total value") (S106). Here, the main scanning period drive number Ks is the number of the individual designation signals Sd[m], out of the (Q×M) individual designation signals Sd[m], which are included in the Q print signals SI supplied to the supply circuit 61 in the other main scanning period Ws and indicates the "value that designates ejection of ink." More specifically, in the embodiment, the main scanning period drive number Ks is the number of the individual designation signals Sd[m] representing (1, 1), (1, 0), or (0, 1), out of the (Q×M) individual designation signals Sd[m], which are included in the Q print signals SI supplied to the supply circuit 61 in the other main scanning period Ws.

Then, based on the temperature information XT obtained in the step S100 and the main scanning period drive number Ks calculated in the step S106, the temperature estimation section 233 of the stop control section 23 calculates the estimated temperature XS (S108). Here, the estimated temperature XS is an estimated value of the measured temperature of the thermistor TM at the end of the other main scanning period Ws.

Specifically, the temperature estimation section 233 calculates the estimated temperature XS in the step S108 such that the estimated temperature XS increases as the temperature indicated by the temperature information XT increases.

Further, the temperature estimation section 233 calculates the estimated temperature XS in the step S108 such that the estimated temperatures XS increases as the main scanning drive number Ks increases. Specifically, the temperature estimation section 233 calculates the estimated temperature XS in the step S108 such that the estimated temperature XS increases higher when the main scanning period drive number Ks is Ks1 (an example of "the first value") than when the main scanning period drive number Ks is Ks2 (an example of "the second value"), which is smaller than Ks1.

As an example, the temperature estimation section 233 may add up the temperature indicated by the temperature information XT and the value obtained by multiplying the main scanning period drive number Ks by a positive coefficient to calculate the estimated temperature XS in the step S108.

Next, the temperature determination section 231 of the stop control section 23 determines whether or not the estimated temperature XS calculated by the temperature estimation section 233 in the step S108 is equal to or higher than the upper limit temperature H1 (an example of "predetermined temperature") set in advance (S110). Here, the upper limit temperature H1 is the temperature higher than the reference temperature H0. For example, the upper limit temperature H1 may be the temperature set in advance based on the temperature at which the possibility that waveform of the drive signal Com becomes inaccurate becomes higher than a predetermined ratio, the temperature at which the possibility that ejection of ink from the ejection section D becomes inaccurate becomes higher than a predetermined ratio, or the like.

When result of determination is affirmative in the step S110, the stop period decision section 234 of the stop control section 23 decides the time length of one stop period Wt based on the estimated temperature XS (S112) and ends the stop period decision process illustrated in FIG. 8.

For example, the stop period decision section 234 may decide the time length of one stop period Wt in the step S112 such that the time length of one stop period Wt increases as the estimated temperature XS increases. In this case, for example, the stop period decision section 234 may add up a predetermined time length and the time length set according to the estimated temperature XS and decide the add-up time length as the time length of one stop period Wt.

Further, for example, the stop period decision section 234 may decide the time length of one stop period Wt in the step S112 such that the time length of one stop period Wt increases as difference between the estimated temperature XS and the upper limit temperature H1 increases. In this case, for example, the stop period decision section 234 may add up a predetermined time length and the time length set according to the difference between the estimated temperature XS and the upper limit temperature H1 and decide the added-up time length as the time length of one stop period Wt.

Further, for example, the stop period decision section 234 may decide the time length of one stop period Wt in the step S112 such that the time length of one stop period Wt increases as the difference between the estimated temperature XS and the reference temperature H0 increases. In this case, for example, the stop period decision section 234 may add up the predetermined time length and the time length set according to the difference between the estimated temperature XS and the reference temperature H0 and decide the added-up time length as the time length of one stop period Wt.

When the result of determination in the step S102 is negative, or when the result of determination in the step S110 is negative, the stop period decision section 234 of the stop control section 23 decides predetermined time length as the time length of one stop period Wt (S114) and ends the stop period decision process illustrated in FIG. 8.

5. Conclusion of Embodiments

As described above, in the embodiment, based on the temperature information XT output from the temperature measurement circuit 51, the time length of the stop period Wt in which generation of the drive signal Com is stopped in the drive signal generation circuit 40 is decided.

Hereinafter, before effect of the embodiment is described, features of ink jet printers that have been manufactured and released in recent years will be described below.

FIG. 9 is a descriptive diagram for comparing features of the ink jet printers released in the past (2002) and features of the ink jet printers released in recent years (2017).

In FIG. 9, "PIXUS MP 10" manufactured by Canon Inc. and "Colorio CC-570L" manufactured by Seiko Epson Corporation are presented as examples of the ink jet printers released in the past.

Further, in FIG. 9 "PIXUS TS 5130" manufactured by Canon Inc. and "Colorio EP-810A" manufactured by Seiko Epson Corporation are presented as examples of the ink jet printers released in recent years.

As illustrated in FIG. 9, the ink jet printers released in recent years are downsized, compared to the ink jet printers release in the past. Specifically, in the products presented in FIG. 9, the ink jet printers released in recent years have a volume of around 43% to 47% of the volume of the ink jet printers released in the past. That is, in recent years, demand for downsizing of the ink jet printer is strong.

If demand for downsizing of the ink jet printer is to be met, downsizing of the control unit 2 is necessary, since downsizing of the recording paper P and the transport unit 7 is difficult. Downsizing of the control unit 2 necessitates downsizing of the substrate 200 on which various constituent elements of the control unit 2 are mounted. However, when the substrate 200 is downsized, heat dissipation efficiency from the substrate 200 also declines so that the possibility that the substrate 200 is heated to a high temperature (for example, the temperature exceeds the upper limit temperature H1) increases. In particular, since the drive signal generation circuit 40 that generates drive signal Com with a large amplitude is provided on the substrate 200, if the heat generated in the drive signal generation circuit 40 is not effectively dissipated via the substrate 200, the drive signal generation circuit 40 is heated to a high temperature, and not only operation of the drive signal generation circuit 40 becomes unstable but the operation of the control circuit 20 may also become unstable since the control circuit 20 formed on the same substrate 200 as the drive signal generation circuit 40 is also heated to a high temperature. When the operation of the drive signal generation circuit 40, the control circuit 20 and the like becomes unstable, quality of print by ink jet printer deteriorates, and, furthermore, a problem arises that the possibility that a failure occurs in the ink jet printer increases.

Further, as illustrated in FIG. 9, the ink jet printer released in recent years has printing function three to five times as large as that of the ink jet printer released in the past, and has double the connection interfaces. That is, in recent years, demand for the multifunctional ink jet printer is strong.

However, multi-functionalization of the ink jet printer increases circuit scale and the number of circuits formed on the substrate 200. In particular, multi-functionalization of the ink jet printer with demand for downsizing of the substrate 200 into consideration necessitates refinement, high densification, and high integration of circuits formed on the substrate 200. Refinement, high densification and high integration of circuits formed on the substrate 200 will increase the amount of heat generated per unit area of the circuits formed on the substrate 200, and a problem arises that the circuit formed on the substrate 200 is heated to a high temperature.

In this way, in recent years when demand for downsizing and multi-functionalization of ink jet printer is strong, the problem of rising temperature of circuits such as the drive signal generation circuit 40 formed on the substrate 200 and the like has been revealing itself.

On the other hand, as demonstrated in FIG. 9, ink jet printers released in recent years consume electric power approximately 42% to 77% less than the ink jet printers released in the past. That is, demand for lowered electric power consumption of the ink jet printer is strong.

However, as described above, since the ink jet printer includes the drive signal generation circuit 40 that generates the drive signal Com with a large amplitude, the problem is that it is not easy to lower electric power consumption of the ink jet printer.

On the contrary, based on the temperature information XT output from the temperature measurement circuit 51, the ink jet printer 1 according to the embodiment decides the time length of the stop period Wt in which generation of the drive signal Com is stopped in the drive signal generation circuit 40. In other words, when the temperature of the substrate 200 indicated by the temperature information XT is equal to or higher than the reference temperature H0 and the temperature of the substrate 200 is expected to become equal to or higher than the upper limit temperature H1 after the end of main scanning period Ws, the ink jet printer 1 according to the embodiment starts the main scanning period Ws after waiting for the temperature of the control circuit 20 to drop by changing the time length of the stop period Wt in which generation of the drive signal Com is stopped in the drive signal generation circuit 40 to be longer than the predetermined time length. Therefore, in the embodiment, the substrate 200 may be prevented from being heated to a high temperature exceeding the upper limit temperature H1. In this way, according to the embodiment, compared with the case where the stop period Wt is fixed to a predetermined time length, the possibility that the circuit formed on the substrate 200 is heated to a high temperature may be reduced.

Further, the ink jet printer 1 according to the embodiment decides the time length of the stop period Wt based on the main scanning period drive number Ks. In other words, the ink jet printer 1 according to the embodiment decides the time length of the stop period Wt based on the number of times the drive signal Com generated by the drive signal generation circuit 40 is supplied to the ejection section D. Therefore, according to the embodiment, the time length of the stop period Wt may be extended when a large electric current flows to the drive signal generation circuit 40 so that the drive signal generation circuit 40 supplies the drive signal Com to a large number of the ejection sections D compared to the case where the drive signal generation circuit 40 supplies the drive signal Com to a small number of the ejection sections D. In this way, according to the embodiment, as compared with the case where the stop period Wt is fixed to a predetermined time length, the possibility that the drive signal generation circuit 40 is heated to a high temperature may be reduced.

Further, according to the embodiment, since the generation of drive signal Com by the drive signal generation circuit 40 is stopped in the stop period Wt, amount of electric power consumption in the ink jet printer 1 may be reduced as compared with the case where the drive signal generation circuit 40 still keeps the generating drive signal Com in the stop period Wt.

B. MODIFICATION EXAMPLES

Each of the above aspects may be modified variously. Examples of specific modification aspects are presented below. Two or more aspects randomly selected from the following examples may be appropriately combined within a range in which the aspects do not contradict one another. As for the elements, the operation and the function of which are equivalent to the operation and the function of aspects in the illustrated modification examples, the detailed description will not be repeated as deemed appropriate by using the reference numerals referred to in the above descriptions.

Modification Example 1

In the embodiment described above, the stop control section 23 decides the time length of the stop period Wt without considering presence or absence of execution of reading process, but the invention is not limited to such an aspect. Stop control section 23 may determine the time length of the stop period Wt based on presence or absence of execution of reading process.

Figure 10:
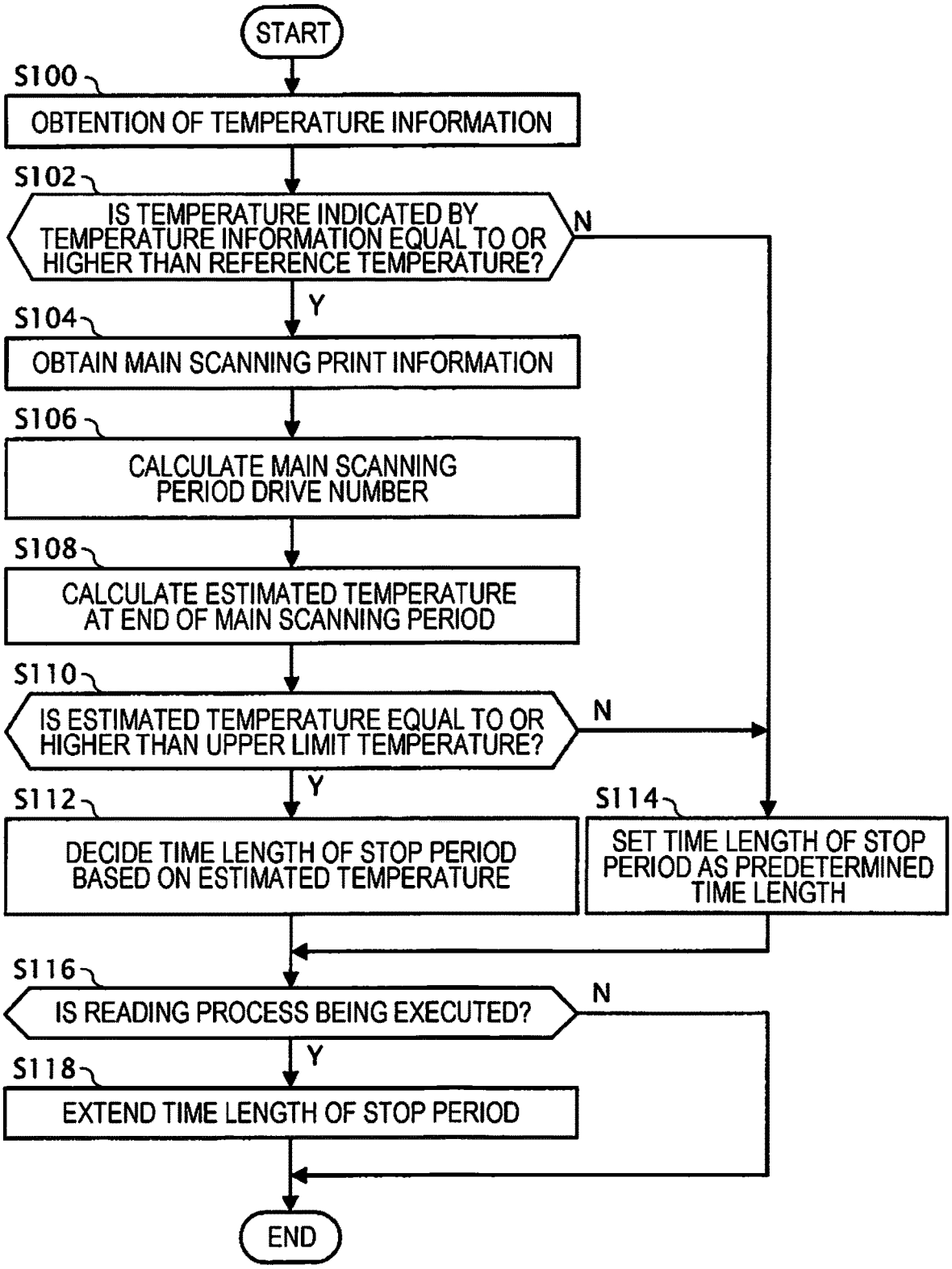
FIG. 10 is a timing chart illustrating an example of the operation of the ink jet printer in the stop period decision process according to Modification Example 1.

FIG. 10 is a flowchart illustrating operation of the stop control section 23 when the stop period decision process according to this modification example is executed. The flowchart illustrated in FIG. 10 is the same as the flowchart illustrated in FIG. 8, except that processes of the steps S116 and S118 are executed.

As illustrated in FIG. 10, after executing processes of the steps S112 or S114, the stop period decision section 234 determines whether or not the ink jet printer 1 is the executing reading process (S116).

When the result of determination in the step S116 is affirmative, the stop period decision section 234 extends the time length of the stop period Wt decided the in step S112 or S114 (S118) and ends the stop period decision process illustrated in FIG. 10. Specifically, the stop period decision section 234 executes calculation of adding up a positive real number value with, or multiply by a positive real number value, the time length of the stop period Wt decided in the step S112 or S114 and decides the value obtained as the calculation result as the time length of the stop period Wt in the step S118.

Further, when the result of determination in the step S116 is negative, the stop period decision section 234 ends the stop period decision process illustrated in FIG. 10. That is, when the result of determination in the step S116 is negative, the stop period decision section 234 ends the stop period decision process without changing the time length of the stop period Wt decided in the step S112 or S114.

In this way, the stop period decision section 234 sets the time length of the stop period Wt longer when the reading process is executed than when the reading process is not executed. Therefore, in the modification example, the time length of the stop period Wt may be set to the time length in consideration of the heat generation accompanying execution of reading process, and the substrate 200 may also be prevented from being heated to a high temperature exceeding the upper limit temperature H1 when the reading process is being executed.

Modification Example 2

In the embodiment and modification example described above, the stop control section 23 may set the time length of the stop period Wt longer than the predetermined time length at least when the temperature indicated by the temperature information XT obtained from the temperature measurement circuit 51 is equal to or higher than the reference temperature H0, but the invention is not limited to such an aspect. The stop control section 23 may be able to set the time length of the stop period Wt longer than the predetermined time length whether or not the temperature indicated by the temperature information XT obtained from the temperature measurement circuit 51 is equal to or higher than the reference temperature H0.

Figure 11:
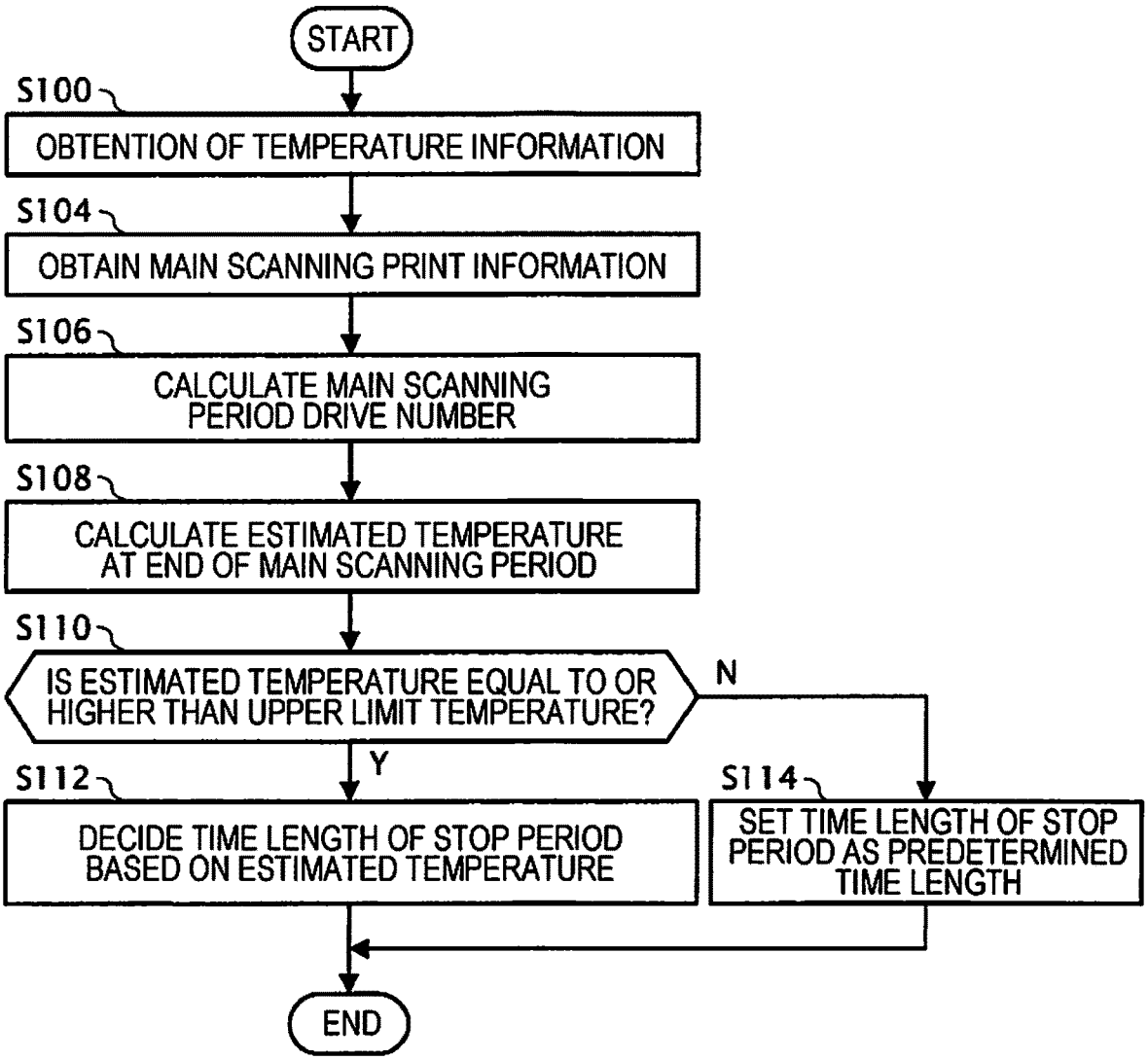
FIG. 11 is a timing chart illustrating an example of the operation of the ink jet printer in the stop period decision process according to Modification Example 2.

FIG. 11 is a flowchart illustrating operation of the stop control section 23 when the stop period decision process according to this modification example is executed. The flowchart in FIG. 11 is the same as the flowchart in FIG. 8 except that the process of step S102 is not executed.

As illustrated in FIG. 11, the stop control section 23 calculates the estimated temperature XS based on temperature information XT obtained in the step S100 (S108) without determining whether or not the temperature indicated by the temperature information XT obtained in the step S100 is equal to or higher than the reference temperature H0. Then, when the estimated temperature XS is equal to or. higher than the upper limit temperature H1 (S110:Y), the stop period decision section 234 of the stop control section 23 decides the time length of the stop period Wt based on the estimated temperature XS and the number of the main scanning period drives Ks (S112). In the modification example, the stop control section 23 may be configured not to include the reference determination section 232.

In this way, the stop control section 23 according to the modification example skips the process of determining whether or not the temperature indicated by the temperature information XT is equal to or higher than the reference temperature H0, and thus, processing load in the stop control section 23 may be reduced.

Modification Example 3

In the embodiment and modification example described above, the stop period decision section 234 decides the time length of the stop period Wt based on the estimated temperature XS and the number of the main scanning period drives Ks, but the invention is not limited to such an aspect. The stop period decision section 234 may decide the time length of the stop period Wt based on the estimated temperature XS at least. In this case, for example, the temperature estimation section 233 may calculate the estimated temperature XS by adding up a positive real number value set in advance and the temperature indicated by the temperature information XT or may calculate the estimated temperature XS by adding up a positive real number value corresponding to the width Yp and the temperature indicated by the temperature information XT.

Modification Example 4

In the embodiment and modification example described above, the stop control section 23 determines the time length of the stop period Wt at least based on the estimated temperature XS calculated by the temperature estimation section 233, but the invention is not limited to such an aspect. The stop control section 23 may decide the time length of the stop period Wt based on the temperature information XT obtained from the temperature measurement circuit 51.

Figure 12:
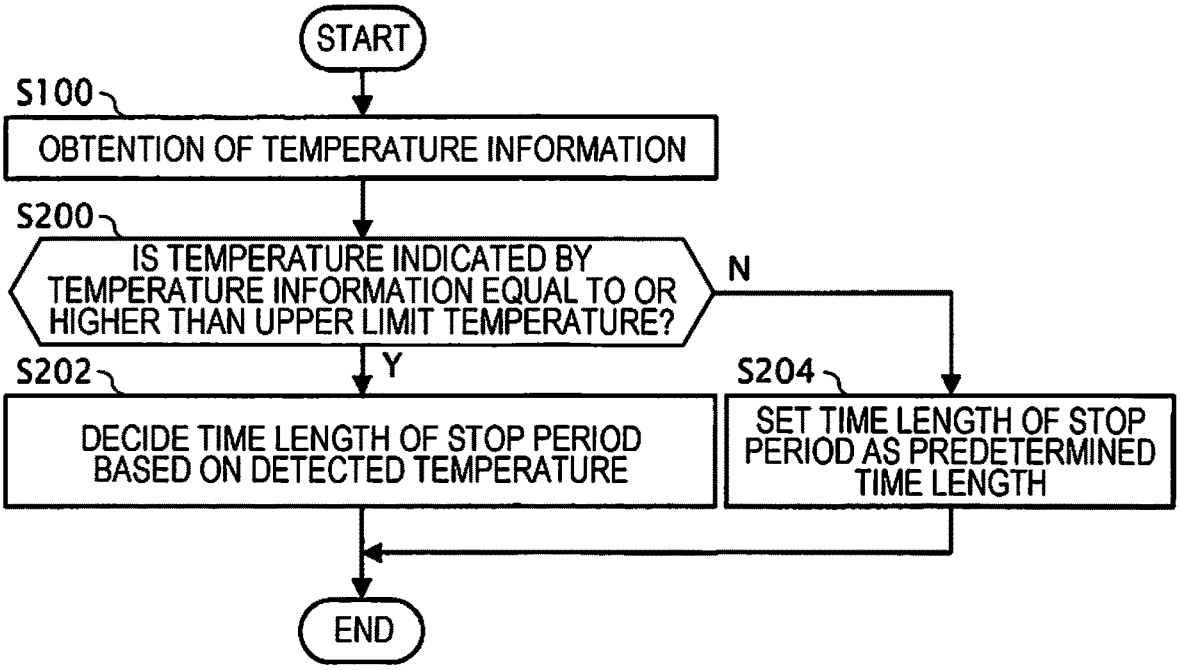
FIG. 12 is a timing chart illustrating an example of the operation of the ink jet printer in the stop period decision process according to Modification Example 4.

FIG. 12 is a flowchart illustrating operation of the stop control section 23 when the stop period decision process according to this modification example is executed.

As illustrated in FIG. 12, when the stop period decision process starts, the stop control section 23 first obtains the temperature information XT output from the temperature measurement circuit 51 (S100).

Next, the temperature determination section 231 of the stop control section 23 determines whether or not the temperature indicated by the temperature information XT obtained in the step S100 is equal to or higher than the upper limit temperature H1 (S200).

When the result of determination in the step S200 is affirmative, the stop period decision section 234 of the stop control section 23 decides the time length of the stop period Wt (S202) based on the temperature information XT, and ends the stop period decision process illustrated in FIG. 12. Specifically, the stop period decision section 234 may decide the time length of the stop period Wt in the step S202 so that the time length of the stop period Wt increases as the temperature indicated by the temperature information XT increases. For example, the stop period decision section 234 may add up the predetermined time length and the time length set according to the temperature information XT and decide the added-up time length as the time length of the stop period wt.

On the other hand, when the result of determination in the step S200 is negative, the stop period decision section 234 of the stop control section 23 decides the predetermined time length as the time length of the stop period Wt (S204) and ends the stop period decision process illustrated in FIG. 12.

Further, in the present modification example, the stop control section 23 may include the temperature determination section 231 and the stop period decision section 234 at least.

In this way, the stop control section 23 according to the present modification example decides the time length of the stop period Wt to be longer than the predetermined time length when the temperature indicated by the temperature information XT is equal to or higher than the upper limit temperature H1. Therefore, the modification example may reduce the possibility that the substrate 200 is heated to a high temperature exceeding the upper limit temperature H1, compared with the case where the time length of the stop period Wt is set a predetermined time length.

Modification Example 5

In the embodiment and modification example described above, the stop period Wt is a period between one main scanning period Ws and another main scanning period Ws, but the invention is not limited to such an aspect. The stop period Wt may be a period between the execution period of one print task and the execution period of another print task that is executed first after the end of the one print task. Further, the stop period Wt may be a period between the execution period of one print job and the execution period of another print job that is executed first after the end of the one print job. Further, the stop period Wt may be a period between one unit period Tu and another unit period Tu that is first provided after the end of the one unit period Tu.

Modification Example 6

In the embodiment and modification example described above, the ink jet printer 1 includes one drive signal generation circuit 40 and one head unit 6, but the invention is not limited to such an aspect. The ink jet printer 1 may include a plurality of the drive signal generation circuits 40 and a plurality of the head units 6.

For example, by selectively supplying a plurality of the drive signals Com that have waveforms different from each other to each of the ejection section D included in the head unit 6, the ink jet printer 1 may drive the ejection section D. In this case, on the substrate 200, a plurality of the drive signal generation circuits 40 may be provided for one-to-one correspondence with the plurality of the drive signals Com.

Further, for example, the ink jet printer 1 may include a plurality of the head units 6. In this case, on the substrate 200, a plurality of the drive signal generation circuits 40 may be provided for one-to-one correspondence with the plurality of the head units 6.

Modification Example 7

In the embodiment and modification example described above, the case is assumed where the ink jet printer 1 is a serial printer, but the invention is not limited to such an aspect. The ink jet printer 1 may be a so-called line printer in which a plurality of the nozzles N are provided to extend wider than width of the recording paper P in recording head 62.

What is claimed is:

1. A liquid ejecting apparatus comprising:

a scanner unit that reads an image formed on a medium;

a scanner drive section that drives the scanner unit;

a head unit that is provided with an ejection section that ejects a liquid;

a drive signal generation section that generates a drive signal for driving the ejection section;

a casing in which the head unit is disposed;

a temperature information output section that outputs temperature information indicating a value corresponding to a temperature of a predetermined portion in the casing; and a stop control section that decides a time length of a stop period in which the drive signal generation section stops generating the drive signal based on the temperature information, wherein the time length is longer when the scanner unit is driven than when the scanner unit is not driven.

2. The liquid ejecting apparatus according to claim 1, further comprising:

a designation signal output section that outputs a designation signal for designating the ejection section to be driven by the drive signal in a unit period out of M (M is a natural number equal to or greater than one) ejection sections that are provided in the head unit; and a drive signal supply section that drives the ejection section designated by the designation signal by supplying the drive signal to the ejection section designated by the designation signal in the unit period, wherein the stop control section is capable of deciding the time length of the stop period based on a total value of the number of the ejection sections designated by one or a plurality of designation signals that the designation signal output section outputs in a print period that includes one or a plurality of unit periods and that is started after an end of the stop period.

3. The liquid ejecting apparatus according to claim 2, wherein the stop control section includes a temperature estimation section that calculates an estimated temperature that is a temperature at the predetermined portion at the end of the print period based on the temperature information and the total value, a temperature determination section that determines whether or not the estimated temperature is equal to or higher than a predetermined temperature, and a decision section that decides the time length of the stop period based on the estimated temperature when determination result of the temperature determination section is affirmative and decides the time length of the stop period as a predetermined time length when determination result of the temperature determination section is negative.

4. The liquid ejecting apparatus according to claim 2, wherein the stop control section includes a reference determination section that determines whether or not a temperature indicated by the temperature information is equal to or higher than a reference temperature, a temperature estimation section that calculates an estimated temperature that is a temperature at the predetermined portion at the end of the print period based on the temperature information and the total value when the determination result of the reference determination section is affirmative, a temperature determination section that determines whether or not the estimated temperature is equal to or higher than a predetermined temperature, and a decision section that decides the time length of the stop period based on the estimated temperature when determination result of the temperature determination section is affirmative and decides the time length of the stop period as a predetermined time length when determination result of the reference determination section is negative or when determination result of the temperature determination section is negative.

5. The liquid ejecting apparatus according to claim 2, wherein the stop control section decides the time length of the stop period so that the time length of the stop period when the total value is a first value is longer than the time length of the stop period when the total value is a second value which is smaller than the first value.

6. The liquid ejecting apparatus according to claim 1, wherein the stop control section includes a temperature determination section that determines whether or not a temperature indicated by the temperature information is equal to or higher than a predetermined temperature, and a decision section that decides the time length of the stop period based on the temperature information when determination result of the temperature determination section is affirmative and decides the time length of the stop period as a predetermined time length when determination result of the temperature determination section is negative.

7. The liquid ejecting apparatus according to claim 1, wherein the drive signal generation section and the stop control section are mounted on a single circuit board.

8. The liquid ejecting apparatus according to claim 7, wherein the temperature information output section measures a temperature of the circuit board and outputs the temperature information indicating the measurement result.

9. The liquid ejecting apparatus according to claim 1, wherein the drive signal generation section, the stop control section, and the scanner drive section are mounted on a single circuit board.

* * * * *